US006926584B2

(12) United States Patent
Chang et al.

(10) Patent No.: US 6,926,584 B2
(45) Date of Patent: Aug. 9, 2005

(54) DUAL MODE HYBRID CONTROL AND METHOD FOR CMP SLURRY

(75) Inventors: Chao-Jung Chang, Yunghe (TW); Ping-Hsu Chen, Taichung (TW); Chin-Hsin Peng, Hsin-Chu (TW); Jui-Cheng Lo, Hsinchu (TW); Chien-Kuo Lu, Hsinchu (TW); Chien-Ling Huang, Hsinchu (TW)

(73) Assignee: Taiwan Semiconductor Manufacturing Co., Ltd., Hsin Chu (TW)

( * ) Notice: Subject to any disclaimer, the term of this patent is extended or adjusted under 35 U.S.C. 154(b) by 187 days.

(21) Appl. No.: 10/267,614

(22) Filed: Oct. 9, 2002

(65) Prior Publication Data

US 2004/0072503 A1 Apr. 15, 2004

(51) Int. Cl.[7] ..... B24B 49/00

(52) U.S. Cl. ..... 451/5; 451/11; 451/36; 451/41; 451/60; 73/861; 73/197

(58) Field of Search ..... 451/5, 8, 11, 36, 451/41, 60, 59, 63, 285, 287, 307, 289, 296; 73/861, 196, 197; 417/20, 26, 43

(56) References Cited

U.S. PATENT DOCUMENTS 3,877,287 A * 4/1975 Duntz, Jr. ..... 73/1.22
3,881,990 A * 5/1975 Burton et al. ..... 435/1.2
4,767,417 A * 8/1988 Boehringer et al. ..... 604/31
4,966,691 A * 10/1990 Brous ..... 210/87
5,046,925 A * 9/1991 Fletcher ..... 417/138
5,273,664 A * 12/1993 Schulz ..... 210/759

* cited by examiner

*Primary Examiner*—Eileen P. Morgan
(74) *Attorney, Agent, or Firm*—Tung & Associates

(57) ABSTRACT

A DMHC (dual mode hybrid control) system and method which facilitates enhanced control in the delivery of polishing slurry to a CMP (chemical mechanical polishing) apparatus. The DMHC comprises a linear table and a PID (proportional integrated differential) controller operably connected to a slurry pump provided in a slurry flow conduit which delivers the polishing slurry to the CMP apparatus. A bubble trap and a flowmeter provided in the slurry flow conduit downstream of the slurry pump are operably connected to the PID controller, and the CMP apparatus is located downstream of the flowmeter.

15 Claims, 3 Drawing Sheets

DUAL MODE HYBRID CONTROL AND METHOD FOR CMP SLURRY

FIELD OF THE INVENTION

The present invention relates to chemical mechanical polishers used for polishing semiconductor wafers in the semiconductor fabrication industry. More particularly, the present invention relates to a dual mode hybrid control and method for the stable and repeatable delivery of polishing slurry to a chemical mechanical polisher in the polishing of semiconductor wafers.

BACKGROUND OF THE INVENTION

Apparatus for polishing thin, flat semiconductor wafers are well-known in the art. Such apparatus normally includes a polishing head which carries a membrane for engaging and forcing a semiconductor wafer against a wetted polishing surface, such as a polishing pad. Either the pad or the polishing head is rotated and oscillates the wafer over the polishing surface. The polishing head is forced downwardly onto the polishing surface by a pressurized air system or similar arrangement. The downward force pressing the polishing head against the polishing surface can be adjusted as desired. The polishing head is typically mounted on an elongated pivoting carrier arm, which can move the pressure head between several operative positions. In one operative position, the carrier arm positions a wafer mounted on the pressure head in contact with the polishing pad. In order to remove the wafer from contact with the polishing surface, the carrier arm is first pivoted upwardly to lift the pressure head and wafer from the polishing surface. The carrier arm is then pivoted laterally to move the pressure head and wafer carried by the pressure head to an auxiliary wafer processing station. The auxiliary processing station may include, for example, a station for cleaning the wafer and/or polishing head, a wafer unload station, or a wafer load station.

More recently, chemical-mechanical polishing (CMP) apparatus has been employed in combination with a pneumatically-actuated polishing head. CMP apparatus is used primarily for polishing the front face or device side of a semiconductor wafer during the fabrication of semiconductor devices on the wafer. A wafer is "planarized" or smoothed one or more times during a fabrication process in order for the top surface of the wafer to be as flat as possible. A wafer is polished by being placed on a carrier and pressed face down onto a polishing pad covered with a slurry of colloidal silica or alumina in deionized water.

CMP polishing results from a combination of chemical and mechanical effects. A possible mechanism for the CMP process involves the formation of a chemically altered layer at the surface of the material being polished. The layer is mechanically removed from the underlying bulk material. An altered layer is then regrown on the surface while the process is repeated again. For instance, in metal polishing, a metal oxide may be formed and removed separately. The chemical mechanical polishing method can be used to provide a planar surface on dielectric layers, on deep and shallow trenches that are filled with polysilicon or oxide, and on various metal films.

Referring next to FIG. 1, a conventional CMP apparatus 50 includes a conditioning head 52, a polishing pad 56, and a slurry delivery arm 54 positioned over the polishing pad 56. The conditioning head 52 is mounted on a conditioning arm 58 which is extended over the top of the polishing pad 56 for making a sweeping motion across the entire surface of the polishing pad 56. The slurry delivery arm 54 is equipped with slurry dispensing nozzles 62 which are used for dispensing a slurry solution on the top surface 60 of the polishing pad 56. Surface grooves 64 are further provided in the top surface 60 to facilitate even distribution of the slurry solution and to help entrapping undesirable particles that are generated by coagulated slurry solution or any other foreign particles which have fallen on top of the polishing pad 56 during a polishing process. The surface grooves 64, while serving an important function of distributing the slurry, also presents a processing problem when the pad surface 60 gradually wears out after prolonged use.

The slurry solution is typically distributed to the slurry dispensing nozzles 62 through tubing (not illustrated), by operation of a pump (not illustrated). One of the key challenges encountered in chemical mechanical polishing is sustaining a stable and repeatable slurry flow to the chemical mechanical polisher. This is particularly important for the fabrication of device features beyond 0.13 $\mu$m. Common characteristics of conventional slurry delivery systems for chemical mechanical polishers include both delayed onset and delayed termination in slurry delivery to the apparatus, both of which decrease the efficiency of the CMP process.

Accordingly, an object of the present invention is to provide a dual mode hybrid control and method for sustaining a stable and repeatable delivery of polishing slurry to a chemical mechanical polisher.

Another object of the present invention is to provide a dual mode hybrid control and method which improves the chemical mechanical polishing process, particularly in the fabrication of device features smaller than 0.13 $\mu$m.

Another object of the present invention is to provide a dual mode hybrid control and method which may be adapted to any type of chemical mechanical polisher.

Still another object of the present invention is to provide a dual mode hybrid control and method which significantly reduces wasting of polishing slurry delivered to a chemical mechanical polisher.

A further object of the present invention is to provide a novel control method for enhancing control of polishing slurry flowing to a chemical mechanical polisher.

Another object of the present invention is to provide a dual mode hybrid control and method which substantially increases the initial flow rate of polishing slurry flowing to a chemical mechanical polisher.

Yet another object of the present invention is to provide a novel control method for significantly reducing periodic maintenance time required for a chemical mechanical polisher.

A still further object of the present invention is to provide a novel control method for delivering polishing slurry to a chemical mechanical polisher, which method enhances the yield of devices on a wafer substrate.

Yet another object of the present invention is to provide a novel control method which is useful for precisely controlling the mixing ratio of abrasive and additive in a polishing slurry delivered to a chemical mechanical polisher.

A still further object of the present invention is to provide a novel control method which enhances the operational range and reliability of a slurry pump in a slurry delivery system for a CMP apparatus.

SUMMARY OF THE INVENTION

In accordance with these and other objects and advantages, the present invention is directed to a DMHC (dual mode hybrid control) system and method which facilitates enhanced control in the delivery of polishing slurry to a CMP (chemical mechanical polishing) apparatus. The DMHC comprises a linear table and a PID (proportional integrated differential) controller operably connected to a slurry pump provided in a slurry flow conduit which delivers the polishing slurry to the CMP apparatus. A bubble trap and a flowmeter provided in the slurry flow conduit downstream of the slurry pump are operably connected to the PID controller, and the CMP apparatus is located downstream of the flowmeter.

In typical application, the DMHC system is initially operated in an open loop control mode, wherein the linear table receives a predetermined flow set value and facilitates rapid onset distribution of the slurry through the slurry flow conduit and delivery to the CMP apparatus through operation of the slurry pump. After a predetermined flow rate of the slurry is achieved and stabilized within a specified target rate range, the DMHC system is operated in a closed loop control mode, wherein the PID controller then receives the flow set value and operates the slurry pump to sustain a continuous flow of slurry through the slurry flow conduit, the bubble trap and the flowmeter, respectively, to the CMP apparatus. By continually receiving flow information from the flowmeter and bubble trap, the PID controller constantly monitors the flow rate of the slurry and normally maintains the slurry flow rate within the specified target rate range. In the event that the flow rate of the slurry either exceeds or falls below the specified range boundaries, the DMHC system temporarily switches back to the open loop control mode, wherein the linear table corrects the slurry flow rate back to within the specified target rate range. At that point, the DMHC system switches again to the closed loop control method actuated by the PID controller. At the end of the polishing process, the open loop control method once again resumes, wherein the PID controller actuates the slurry pump to rapidly decrease the rate of slurry flow to the CMP apparatus, and thus, prevent wasting of the slurry.

BRIEF DESCRIPTION OF THE DRAWINGS

The invention will now be described, by way of example, with reference to the accompanying drawings, in which.

DESCRIPTION OF THE PREFERRED EMBODIMENTS

The present invention has particularly beneficial utility in stabilizing and controlling the delivery rate of polishing slurry to a CMP (chemical mechanical polishing) apparatus in the chemical mechanical polishing of semiconductor wafer substrates. However, the invention is not so limited in application, and while references may be made to such CMP apparatus and CMP polishing slurry, the invention is more generally applicable to controlling flow of liquids through conduits in a variety of industrial and mechanical applications.

Figure 1:
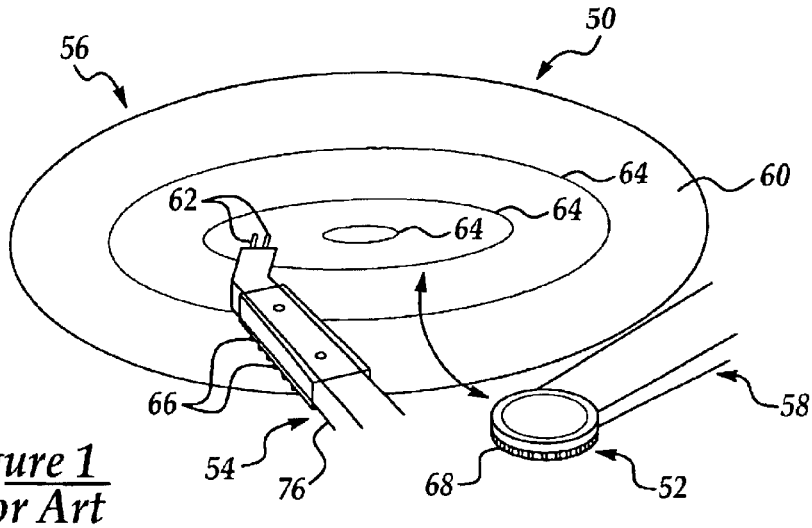
Figure 1 Prior Art
FIG. 1 is a perspective view of a typical conventional CMP (chemical mechanical polishing) apparatus.
Figure 2:
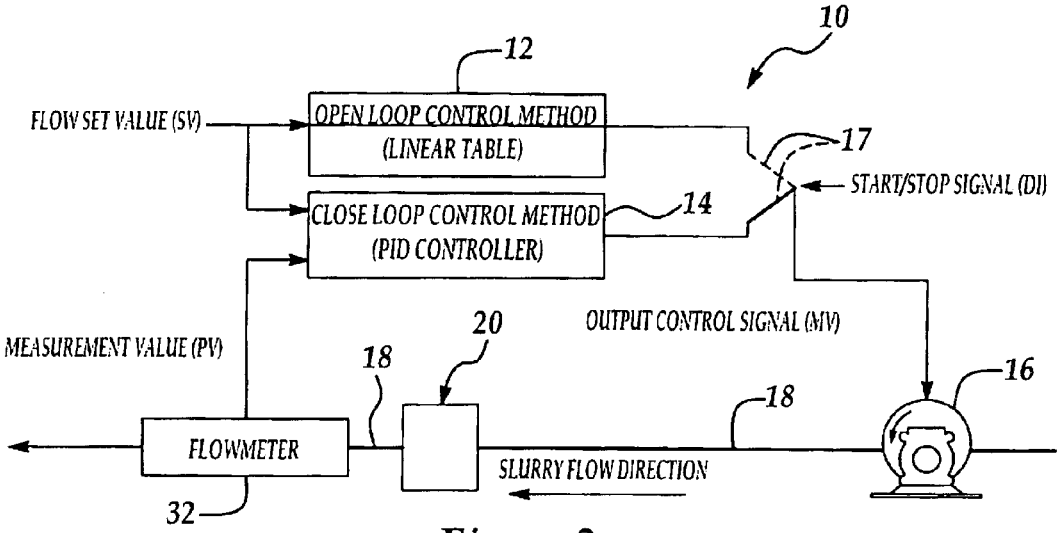
FIG. 2 is a schematic view illustrating a typical embodiment of a DMHC (dual mode hybrid control) system of the present invention.
Figure 3:
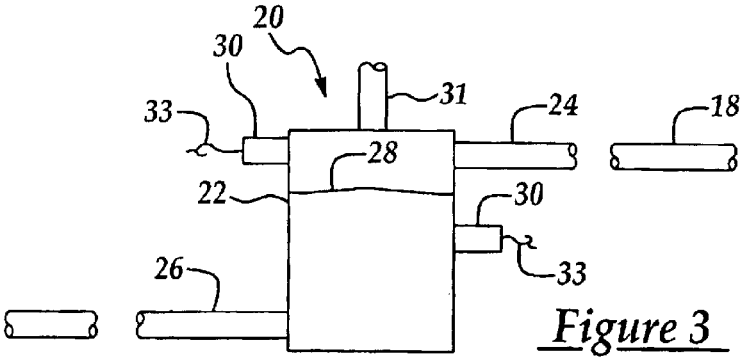
FIG. 3 is a side schematic view, partially in section, illustrating a typical bubble trap component of the DMHC system of the present invention.

Referring initially to FIGS. 2 and 3, an illustrative embodiment of the DMHC (dual mode hybrid control) system of the present invention is generally indicated by reference numeral 10. As shown in FIG. 2, the DMHC system 10 includes a linear table 12 which is adapted for receiving an electrical flow set value (SV) signal corresponding to the desired rate of flow of polishing slurry 28 (FIG. 3) through a slurry flow conduit 18 to a CMP apparatus (not shown in FIGS. 2 and 3). The linear table 12 is operably connected, through a switch 17, to a slurry pump 16 provided in the slurry flow conduit 18. A PID (proportional integrated differential) controller 14, like the linear table 12, is adapted for receiving the SV signal, corresponding to the desired rate of flow of the polishing slurry 28 (FIG. 3) through the slurry flow conduit 18, and is operably connected to the slurry pump 16 through the switch 17. Accordingly, the switch 17 alternately establishes electrical communication between the linear table 12 and the slurry pump 16, as indicated by the dashed line in FIG. 2, and between the PID controller 14 and the slurry pump 16, as indicated by the solid line in FIG. 2. An ultrasonic flow meter 32, which may be conventional, is provided in the slurry flow conduit 18, downstream of the slurry pump 16. A bubble trap 20, which may be conventional, may further be provided in the slurry flow conduit 18, typically upstream of the flowmeter 32, as further shown in FIG. 2. As shown in FIG. 3, the bubble trap 20 may include a tank 22 having an intake arm 24 connected to the upstream segment of the slurry flow conduit 18 and an outlet arm 26 connected to the downstream segment of the slurry flow conduit 18. The tank 22 receives a supply of polishing slurry 28 from the slurry pump 16 and temporarily holds the polishing slurry 28 for ultimate distribution through the flowmeter 32 and to the CMP apparatus, respectively. A vent pipe 31 may extend from the tank 22 for releasing pressure from the tank 22. The tank 22 may be equipped with level sensors 30 for sensing the level of the polishing slurry 28 in the tank 22. The level sensors 30 may be connected to the PID controller 14 through suitable wiring 33.

As hereinafter further described, throughout the chemical mechanical polishing process the DMHC system 10 is switched between two methods or modes of operation, one of which is an open loop control mode in which the linear table 12 receives the predetermined SV signal, which is set by facility personnel and indicates a desired or optimum rate of flow of the slurry 28 through the conduit 18. The linear table 12 transmits an electrical output control (MV) signal, which corresponds in value to the SV signal, to the slurry pump 16 to precisely control the operational speed of the slurry pump 16, and thus, the rate of flow of the polishing slurry 28 through the conduit 18. The open loop mode of operation is used typically at the beginning and end of the CMP process in order to facilitate both rapid onset of slurry flow to within a specified target rate range and rapid termination of slurry flow through the conduit 18. The open loop mode of operation may additionally be used during the CMP process to correct or return the slurry delivery rate to within the specified target rate range when the slurry delivery rate, under operation by the closed loop mode, hereinafter described, either exceeds the range or falls below the range, such as upon inadvertent failure of the flowmeter 32, for example.

The second mode or method of operation of the DMHC system 10 is the closed loop control mode, in which the PID controller 14 receives the SV signal and compares the SV signal to a measurement value (PV) signal that is simultaneously and continually received from the flowmeter 32. The PID controller 14 determines an output control value based on the input provided by the SV signal and the input provided by the PV signal, and transmits an output control (MV) signal, corresponding in magnitude to the output control value, to the slurry pump 16. The MV signal, in turn, determines the operational speed of the slurry pump 16, and thus, the rate of flow of the slurry through the slurry flow conduit 18. The closed loop control mode is used to normally maintain the slurry flow rate through the conduit 18 within the specified target rate range after the open loop control mode is used to initially bring the slurry delivery rate up from zero to the specified target rate range.

Figure 4:
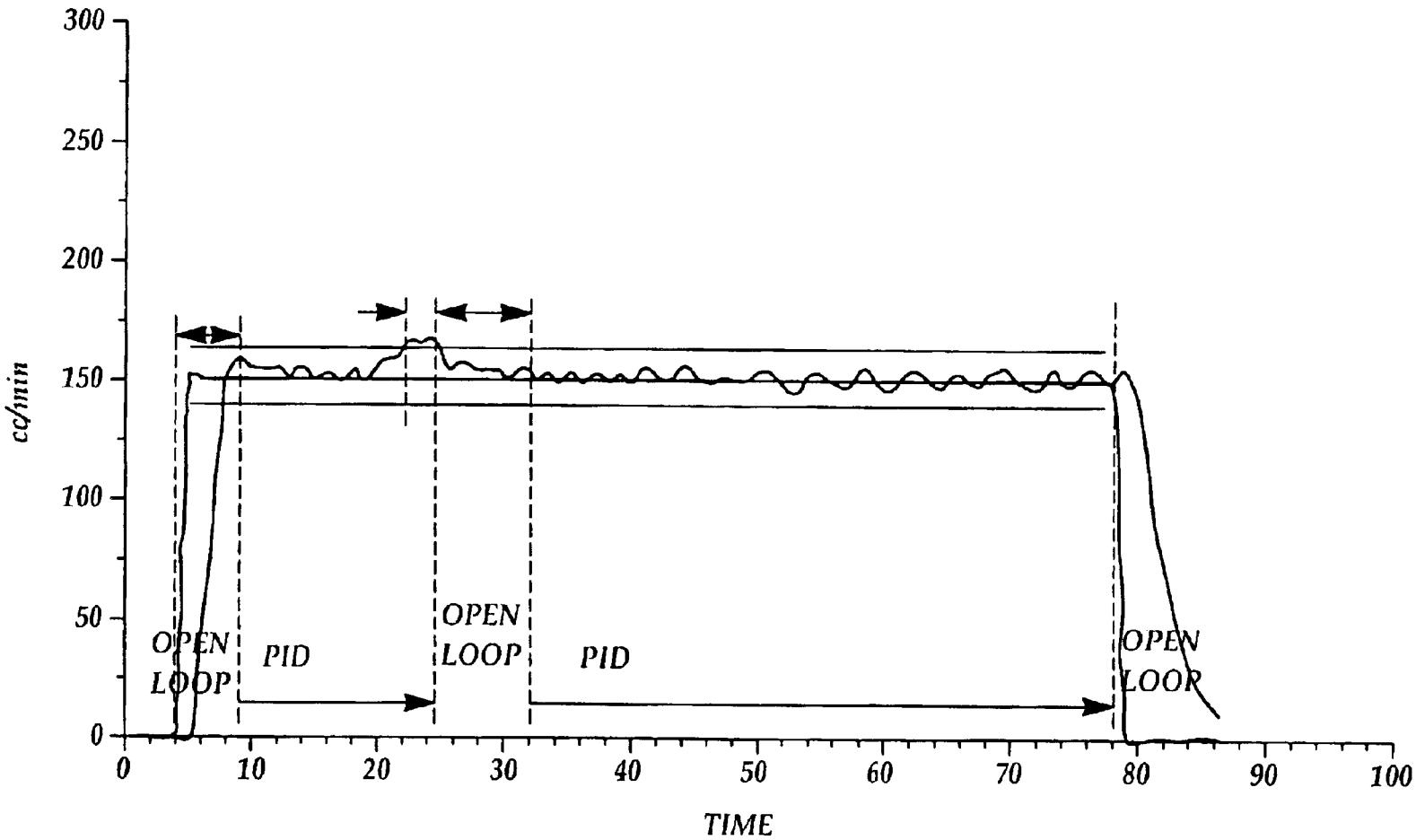
FIG. 4 is a graph illustrating a typical operational scheme for the DMHC system of the present invention.

A typical operational scheme for the DMHC system 10 of the present invention is shown by the graph in FIG. 4, in which the slurry flow rate in cubic centimeters per minute (cc/min) is plotted along the Y-axis and time in seconds is plotted along the X-axis. The time span along the X-axis of the graph from 0 sec. to about 78 sec. indicates the time which elapses during a typical CMP (chemical mechanical polishing) process. At the onset of the CMP process, both the linear table 12 and the PID controller 14 simultaneously receive the predetermined SV (flow set value) signal, the magnitude of which is determined by facility personnel. The DMHC system 10 is initially operated according to the open loop control mode to facilitate rapid onset of slurry flow through the conduit 18 and delivery to the CMP apparatus. Accordingly, as shown in FIG. 2, the switch 17 establishes electrical contact between the slurry pump 16 and the linear table 12, as indicated by the dotted line. The linear table 12 converts the received SV signal to an output control (MV) signal, the value of which corresponds to the value of the SV signal, and transmits the MV signal to the slurry pump 16. Through rapid onset operation of the slurry pump 16, the MV signal from the linear table 12 initiates rapid onset distribution of the slurry through the slurry flow conduit 16 and to the CMP apparatus (not shown) until the rate of slurry distribution rises to within a specified target rate range, typically between about 140 cc/min and about 160 cc/min, as shown in FIG. 4. It will be appreciated from a consideration of FIG. 4 that, through the open loop operational mode, the DMHC system 10 is capable of initiating rapid onset of slurry flow through the conduit 18 to such a degree that very little time elapses between a slurry flow rate of zero and the specified target rate of slurry flow through the conduit 18, as indicated by the near-vertical line of slurry flow onset in the graph of FIG. 4. The difference in the rate of onset in slurry distribution between operation using the open loop mode and operation using the closed loop mode is indicated by the arrow "T1", in which the near-vertical line on the left represents onset of slurry distribution using the open loop mode and the slanted line on the right represents onset of slurry distribution using the closed loop mode. Accordingly, the open loop mode facilitates decreased onset time in the delivery of slurry through the slurry delivery conduit 18, as compared to the closed loop mode.

After the predetermined target flow rate of the slurry 28 through the conduit 18, corresponding in magnitude to the value of the MV signal from the linear table 12, is reached and stabilized within the specified target rate range in the conduit 18, the DMHC system 10 is switched from the open loop to the closed loop control mode, wherein the switch 17 breaks electrical contact between the linear table 12 and the slurry pump 16 and establishes electrical contact between the slurry pump 16 and the PID controller 14, as indicated by the solid line in FIG. 2. The PID controller 14 compares the SV signal to the measurement value (PV) signal simultaneously received from the flowmeter 32 and, based on these signals, determines the output control (Mv) signal to the slurry pump 16. The PID controller 14 thus operates the slurry pump 16 to sustain a continuous flow of the slurry 28 through the slurry flow conduit 18, the bubble trap 20 and the flowmeter 32, respectively, to the CMP apparatus at a rate which falls within the specified target rate range for the rate of slurry flow. By continually receiving flow information from the flowmeter 32, or both the flowmeter 32 and the bubble trap 20, the PID controller 14 constantly monitors the flow rate of the slurry 28 and maintains the flow rate within the specified target rate range. In the event that the flow rate of the slurry 28 either exceeds or falls below the specified target rate range boundaries, as indicated by the arrow T2 (in which the flow rate of the slurry 28 exceeds the specified target rate range) in FIG. 4, the switch 17 is temporarily switched back to the position indicated by the dashed lines in FIG. 2 to initiate the open loop control mode, wherein the linear table 12 corrects the slurry flow rate back to within the specified target rate range by modifying the operational speed of the slurry pump 16 according to the SV signal received by the linear table 12. At that point, the switch 17 re-establishes electrical contact between the PID controller 14 and the slurry pump 16, as indicated by the solid line in FIG. 2, to resume the closed loop control mode actuated by the PID controller 14, as indicated by the arrow "T3" in FIG. 4. At the end of the CMP process, the open loop control mode once again resumes, wherein the linear table 12 actuates the slurry pump 16 to rapidly decrease the rate of slurry flow to the CMP apparatus according to the dynamic SV signal and thus, prevents wasting of the slurry 28.

Figure 5:
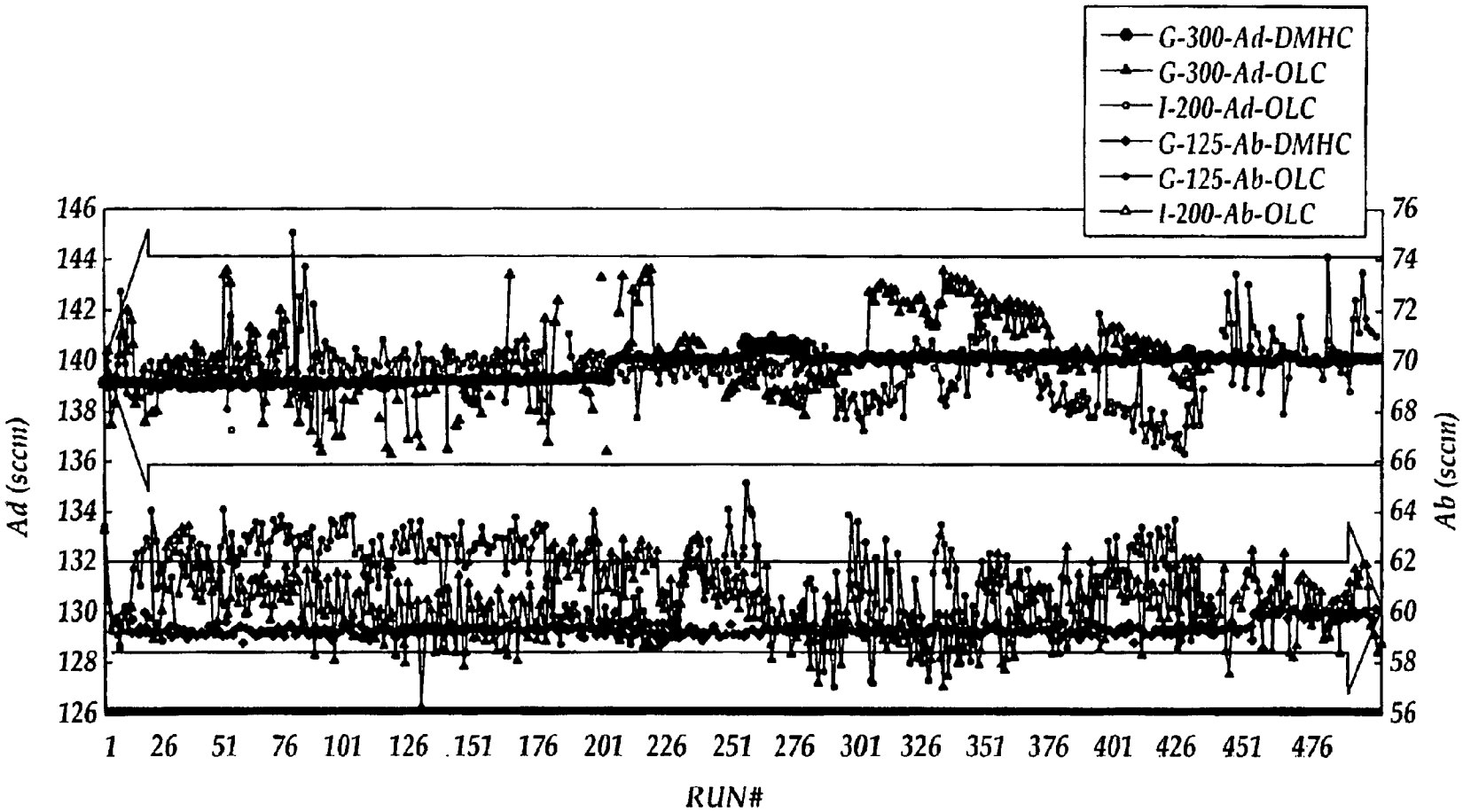
FIG. 5 is a graph illustrating slurry flow rate stability of a conventional slurry delivery system as compared to the present invention.

A graph which illustrates slurry flow rate stability of a conventional slurry delivery system as compared to the slurry flow rate stability of the present invention is shown in FIG. 5, with slurry flow rate plotted along the Y-axis and various runs of CMP processing plotted along the X-axis. From a consideration of the graph, it can be seen that the slurry flow rate stability or uniformity achieved using the DMHC slurry delivery control system of the present invention (shown in the upper portion of the graph) is substantially greater than the slurry flow rate stability or uniformity achieved using the conventional slurry delivery control system (shown in the lower portion of the graph).

While the preferred embodiments of the invention have been described above, various modifications can be made in the invention and the appended claims are intended to cover all such modifications which may fall within the spirit and scope of the invention.

What is claimed is:

1. A method for controlling transport of a fluid through a conduit, comprising the steps of:

providing a pump in fluid communication with said conduit;

operably connecting a linear table to said pump;

operably connecting a controller to said pump;

controlling said pump through said linear table in a first mode of operation to initiate flow of the fluid to within a specified target rate range by sending a flow set value signal to said linear table and transmitting a first output control signal from said linear table to said pump; and controlling said pump through said controller in a second mode of operation to maintain flow of the fluid within said specified target rate range by transmitting a measurement value signal to said controller and transmitting a second output signal from said controller to said pump.

2. The method of claim 1 further comprising the steps of controlling said pump through said first mode of operation in the event that said flow of the fluid falls outside said specified target rate range to return said flow of the fluid to within said specified target rate range and controlling said pump through said second mode of operation when said flow of the fluid returns to within said specified target rate range.

3. The method of claim 1 further comprising the step of controlling said pump through said first mode of operation to terminate said flow of the fluid through said conduit.

4. The method of claim 3 further comprising the steps of controlling said pump through said first mode of operation in the event that said flow of the fluid falls outside said specified target rate range to return said flow of the fluid to within said specified target rate range and controlling said pump through said second mode of operation when said flow of the fluid returns to within said specified target rate range.

5. The method of claim 1 wherein said specified target rate range is about 140 cc/mm to about 160 c/mm.

6. The method of claim 5 further comprising the steps of controlling said pump through said first mode of operation in the event that said flow of the fluid falls outside said specified target rate range to return said flow of the fluid to within said specified target rate range and controlling said pump through said second mode of operation when said flow of the fluid returns to within said specified target rate range.

7. The method of claim 5 further comprising the step of controlling said pump through said first mode of operation to terminate said flow of the fluid through said conduit.

8. The method of claim 1 further comprising the steps of providing a flowmeter in said conduit for monitoring said flow of the fluid, transmitting said measurement value signal from said flowmeter and controlling said pump through said second mode of operation according to said measurement value signal.

9. The method of claim 8 further comprising the steps of controlling said pump through said first mode of operation in the event that said flow of the fluid falls outside said specified target rate range to return said flow of the fluid to within said specified target rate range and controlling said pump through said second mode of operation when said flow of the fluid returns to within said specified target rate range.

10. The method of claim 8 further comprising the step of controlling said pump through said first mode of operation to terminate said flow of the fluid through said conduit.

11. The method of claim 8 wherein said specified target rate range is about 140 cc/mm to about 160 cc/mm.

12. The method of claim 8 further comprising the step of providing a bubble trap in said conduit between said pump and said flowmeter.

13. The method of claim 12 further comprising the steps of controlling said pump through said first mode of operation in the event that said flow of the fluid falls outside said specified target rate range to return said flow of the fluid to within said specified target rate range and controlling said pump through said second mode of operation when said flow of the fluid returns to within said specified target rate range.

14. The method of claim 12 further comprising the step of controlling said pump through said first mode of operation to terminate said flow of the fluid through said conduit.

15. The method of claim 12 wherein said specified target rate range is about 140 cc/mm to about 160 cc/mm.

* * * * *